US005156286A

United States Patent [19]

Piccard

[11] Patent Number: 5,156,286

[45] Date of Patent: Oct. 20, 1992

[54] PEEL SEAL OIL CONTAINER SECURITY SEAL

[76] Inventor: Donald L. Piccard, 1445 East River Rd., Minneapolis, Minn. 55414

[21] Appl. No.: 791,995

[22] Filed: Nov. 14, 1991

[51] Int. Cl.[5] ..... B65D 41/62

[52] U.S. Cl. ..... 215/232; 215/305

[58] Field of Search ..... 215/31, 232, 257, 305; 220/359, 258

[56] References Cited

U.S. PATENT DOCUMENTS 4,739,892 4/1988 Tudek ..... 215/232
4,863,067 9/1989 Krall ..... 222/111
4,869,383 9/1989 Bahr et al. ..... 215/232
4,872,571 10/1989 Ciecelius et al. ..... 215/232
4,953,729 9/1990 Kloosterhouse ..... 215/255

*Primary Examiner*—Stephen Marcus
*Assistant Examiner*—Nova Stucker
*Attorney, Agent, or Firm*—Haugen and Nikolai

[57] ABSTRACT

An improved container for dispensing fluids wherein the container is provided with a conventional pouring spout along with a protective peel seal for retaining the contents of the container intact. An elongated pulling device is secured at one end to the seal and is adapted for applying force from a remote position to removably peel the seal from the container, therey disgorging the contents while the container is in an inverted position.

8 Claims, 7 Drawing Sheets

PEEL SEAL OIL CONTAINER SECURITY SEAL

CROSS-REFERENCE TO RELATED APPLICATION

This application contains the subject matter of applicant's Disclosure Document No. 239,765, filed Nov. 17, 1989.

BACKGROUND OF THE INVENTION

The present invention relates generally to a container opening device for use in combination with a conventional container having a neck design, funnel style pouring spout, and further having a closure cap threadably engaged about the container opening, and further having a security closure film or seal member forming a secondary seal about the opening. Containers of this type are in wide use, and are employed on a substantial basis as containers for motor oil and other often flammable liquids utilized in internal combustion engines such as for automobile crankcases, power steering and brake units, transmissions and the like.

Liquid containers, such as fabricated from polyethylene, polypropylene, or the like are in wide usage for retaining and dispensing a variety of fluids. One very common use of such containers is for retention of crankcase motor oil utilized by motorists for four cycle internal combustion engines. These containers are normally in a generally cylindrical configuration normally with a rectangular cross-section, a bottom wall, a circular spout-like top, and a closure cap adapted to be threadably engaged about the top. A generally planar annular seal surface is provided about the opening, and a tamper-proof closure film is frequently employed to provide a secondary security seal of the container contents with the seal being made about the annular seal surface surrounding the opening. The inner surface of the seal is normally adhesively or heat seal permanently or releasably bonded to the annular surface, and is frequently difficult to perforate and/or remove for pouring of the contents. Such closure films forming secondary seals are commonly employed, and utilized to reduce spillage of the contents, whenever such spillage may lead to creation of hazardous situations or unusual difficulties in shipment.

Due to aerodynamic and styling considerations, the engine compartment of many automobiles is very crowded, making various parts and components almost inaccessible. The opening for the introduction of crankcase oil is often located at an inconvenient point, at a level either at or below that of surrounding components. It is often centrally located so as to provide direct drainage to the engine sump, often directly above the exhaust manifold. In the rare case where the receiving opening is above the surrounding parts, the spout can be inserted into the opening before much liquid has dripped, and a funnel is not necessary—creating the popularity of these spouted containers. But in the common case where the opening is flush with, or below, surrounding obstacles, the spout must be high above the opening, necessitating the use of the now discarded funnel to prevent a hazardous oil spill onto the surrounding components, especially the hot exhaust system.

In the automotive market and the advent of self-service it has become customary for the owner/operator to replenish the fluid levels. The security seal often presents a problem for the user, inasmuch as they are necessarily tough, durable and resistant to tear, in order to fulfill their intended functions in use. Owner/operators do not traditionally have special equipment readily at hand, such as long necked funnels, special can openers and even seal puncturing devices. Puncturing, cutting or tearing the foil seal may introduce bits of foil into the lubrication system of the engine, causing blockage and damage losses.

SUMMARY OF THE INVENTION

In accordance with the present invention, a seal removal means is provided which may be actuated after the container is inverted and the spout is completely inserted well into the opening, thereby making it possible to remove the contents from the container and introduce them into the equipment on a safe and expedient basis. Generally, the seal removal means of the present invention comprises a lanyard extension of one edge of the foil seal in ribbon or band form longer than the depth found desirable to insert the spout into the opening. The ribbon is folded back from the edge of the planar seal over itself and down along the side of the container. After inversion and insertion, the ribbon may be pulled, whereupon the foil seal will peel back and be completely removed from the container and pulled out of the opening in its entirety. The normally cylindrical spout can have a flat, or even a recessed flat, area down the side where the lanyard is deployed (even in the area of the threads for the hard cap) to permit the container and the spout to be forcibly held into the opening without binding on the lanyard as it is pulled.

The ribbon will, in the preferred embodiment, have a ring formed in the anterior portion so that a finger can be inserted therein to enable an adequate tension to be introduced to the ribbon to cause the seal portion to rupture the annular seal in peel. If a heat sealable polyester such as "Scothpak" is used, the material could be three mils thick and one-half inch wide giving an ultimate tensile strength of thirty pounds. The ring embodiment can be either a duplicated die cutting to the seal area at the anterior end of the ribbon with a hole cut therein or the ribbon itself can be folded back and heat sealed to itself forming a loop. The latter would useless material and provide a flat surface rather than an edge for one finger to pull against. The ring and ribbon can be folded accordion style and stored under the threadably engaged cap for storage and shipping or it can be folded over across itself, exactly as it is to be deployed for actuation, led down under the threaded cap (given a loose enough thread tolerance to provide for the half inch wide, two or three mil thick ribbon) and affixed to the side of the container with pressure sensitive adhesive for easy removal in use, or simply heat seal tacked to the side of the container. When the lanyard is folded under the cap, an additional band or keeper can be affixed to the seal area, through which keeper the lanyard is passed, to position it in the proper orientation for rupturing the seal in peel instead of in shear. In the absence of a keeper, the seal area can be extended a short way at the point directly opposed to the lanyard extension, with a hole in that extension. The lanyard is passed through that hole or slot, thereby orienting it properly. An additional advantage of lip extension is that it will act as a pulley to open the seal in peel even if the user pulls it in or along the wrong direction.

The apparatus of the present invention makes it possible for a user to take a filled container, invert the same, and by pulling the ribbon lanyard, remove the foil security seal completely following inversion of the container, even after inserting the container spout into a narrow opening.

Therefore, it is the primary object of the invention to provide an improved and convenient means for opening and pouring containers without spillage of the contents or introduction of foreign matter to the product and without the use of tools or special equipment.

It is yet a further object of the present invention to provide an improved means for removing container seals, wherein means, in the form of a ribbon member, forms an extension of the seal so as to peel such seal from a remote position when such seal is in an inaccessible location.

Other and further objects of the present invention become apparent to those skilled in the art upon a study of the following specification, appended claims, and accompanying drawings.

DESCRIPTION OF THE PREFERRED EMBODIMENT

Figure 1:
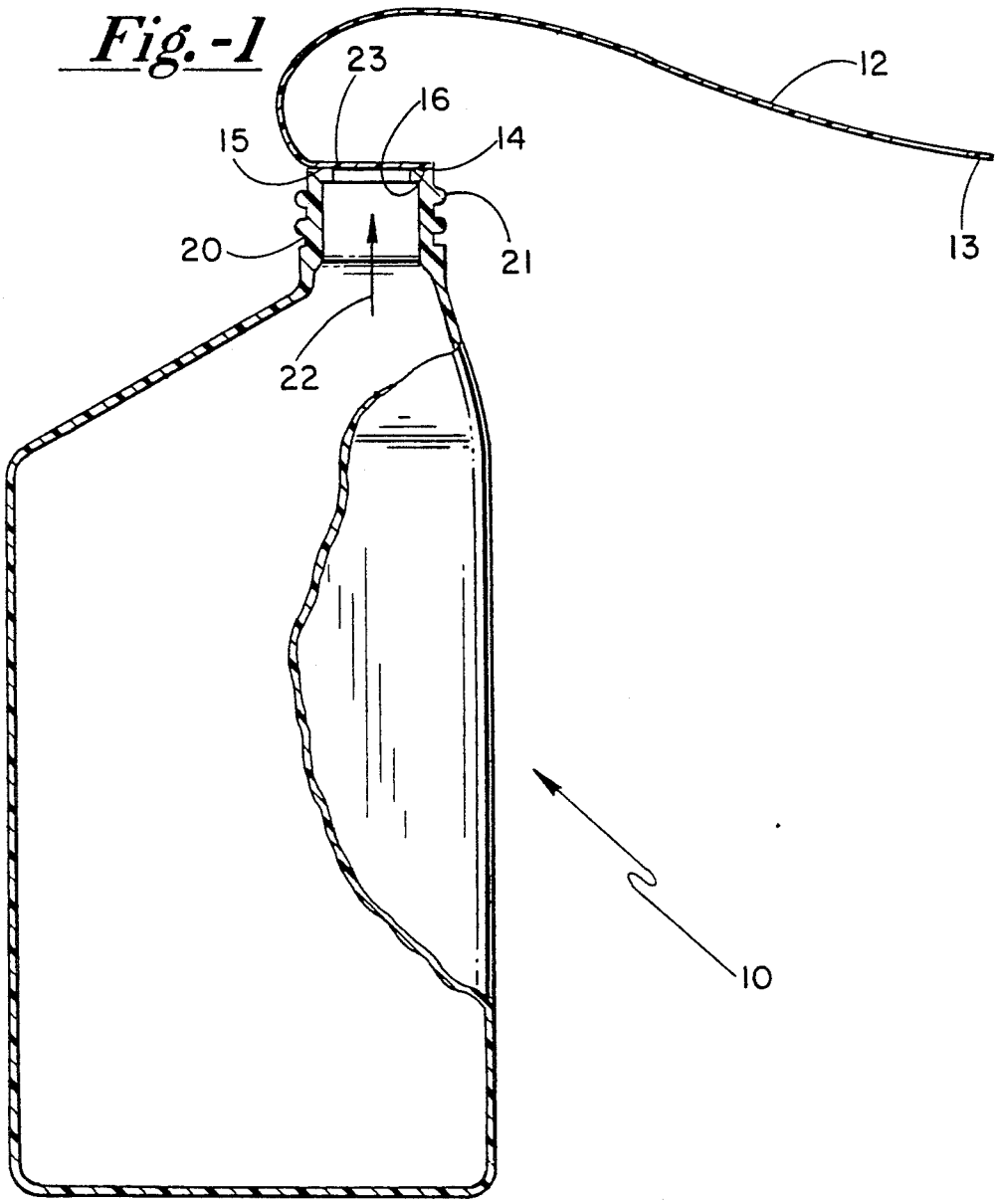
FIG. 1 is a front elevational view in cross section of the typically available container with a closure film and ribbon lanyard device in accordance with the present invention.
Figure 1A:
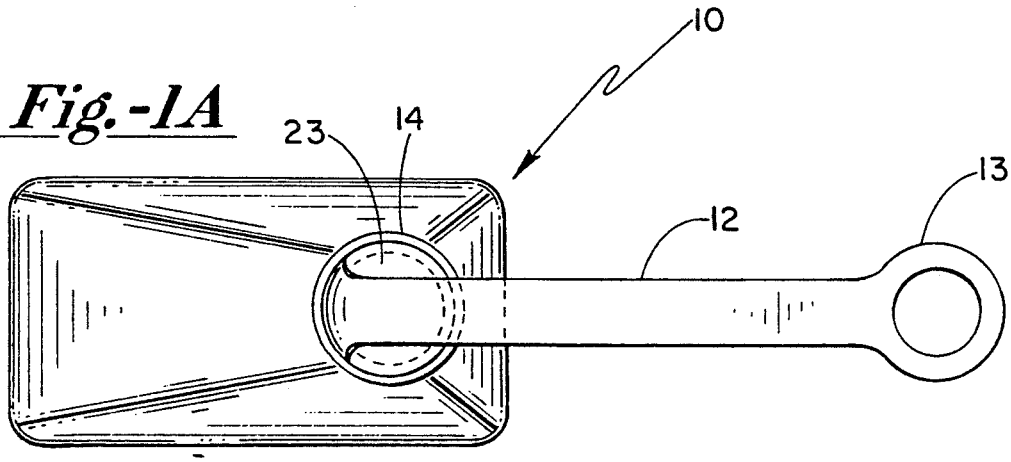
FIG. 1A is a top plan view of the device shown in FIG. 1.

In accordance with the preferred embodiment of the present invention, and with particular attention being directed to FIG. 1 of the drawings, the container generally designated 10 has a spout-like top 20 for a threadably engaged cap (not shown). Specifically, the threaded engagement is provided by means of threads 21 formed about the periphery of the spout, and with the closure cap being provided with internal mating threads. An annular seal surface is provided as at 14, with the annular seal surface being planar and arranged around the entire circumference of the container discharge opening, with the flow of the contents of the container passing through the opening along the line and in the direction of the arrow 22. A closure film 23 is shown as being bonded to the surface of annular seal surface 14, generally by heat sealing adhesive 15 with such closure films being commonly employed in commerce.

Attention is now directed to lanyard 12 extension of closure film 23. The lanyard is deployed with a 180 degree fold at the point it leaves the sealing area, across the sealing area, and down the side of the container ending in loop 13. The loop means 13 generally has the same shape as the sealing area 23 so that after folding the lanyard, the whole means can be stored under the cap for shipping. Internally from the periphery of the loop area 13, a finger hole is cut out forming the loop. The loop alternatively can be formed by bonding the end of the lanyard to itself by the same heat sealing surface used at the annular seal 14. It may also be tacked to the side of the container 10 using pressure sensitive adhesive 16 to locate it properly prior to activation.

DESCRIPTION OF FIRST ALTERNATE PREFERRED EMBODIMENT

Figure 2:
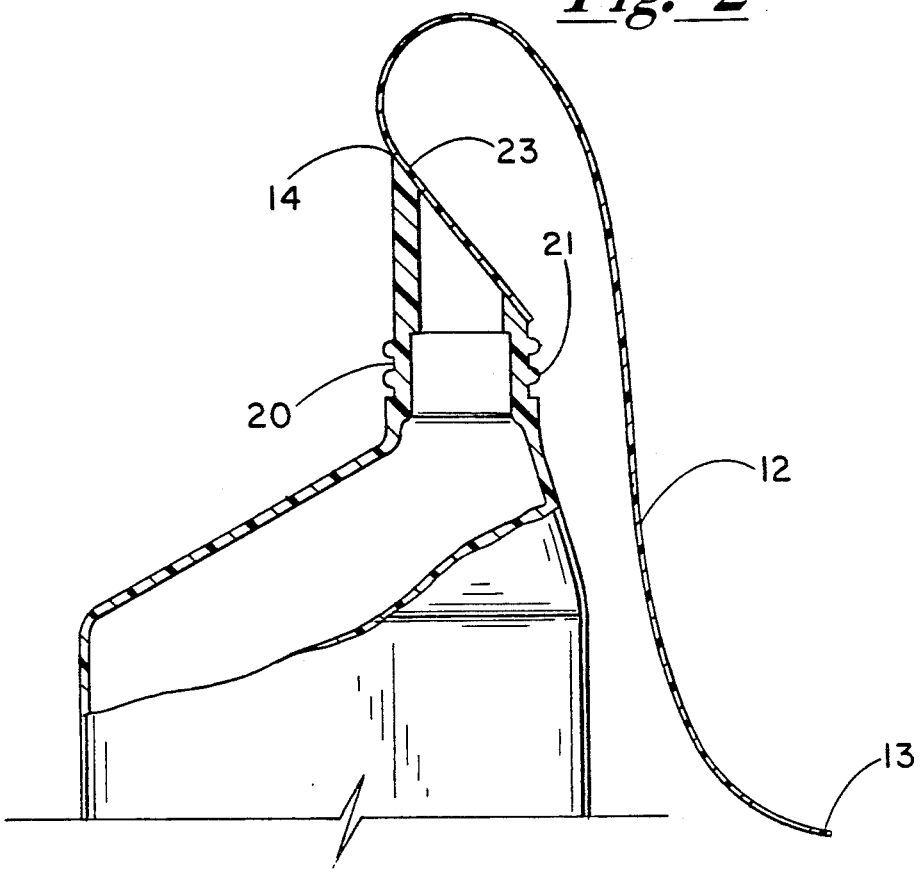
FIG. 2 is similar to FIG. 1, in illustrating a somewhat modified form of the spout.

Attention is now being directed to FIG. 2 of the drawings, where there will be observed that the neck has been extended beyond the threaded portion in an exterior diameter less than the root diameter of the threads. The threadably engaged cap will also be extended to mat with this spout. The extended portion of the spout is formed as cut at an appreciable angle, preferably 30 and 60 degrees, from the axis of the spout. The planar sealing surface forms an ellipse with its major axis in the vertical plane through the axis of the spout when the bottle is in the pouring position. The lower focus when the bottle is in the standing orientation will be the upper focus when the bottle is in the pouring orientation. The extended portion of the seal extends from the upper edge of the ellipse in the standing orientation.

DESCRIPTION OF SECOND ALTERNATE PREFERRED EMBODIMENT

Figure 3:
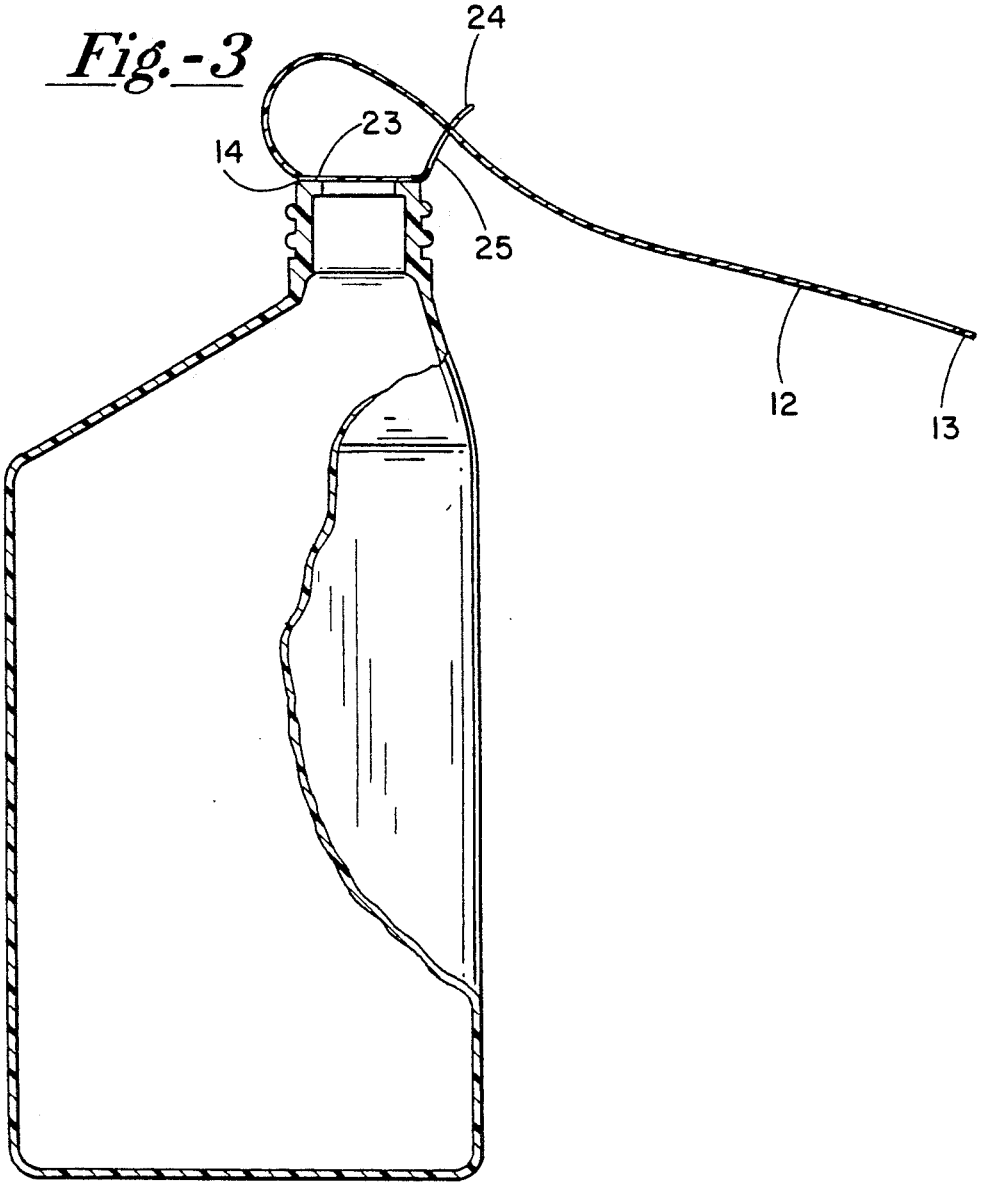
FIG. 3 is similar to FIG. 1, in illustrating a still further embodiment of the present invention with a somewhat modified form of the seal and lanyard configuration.
Figure 3A:
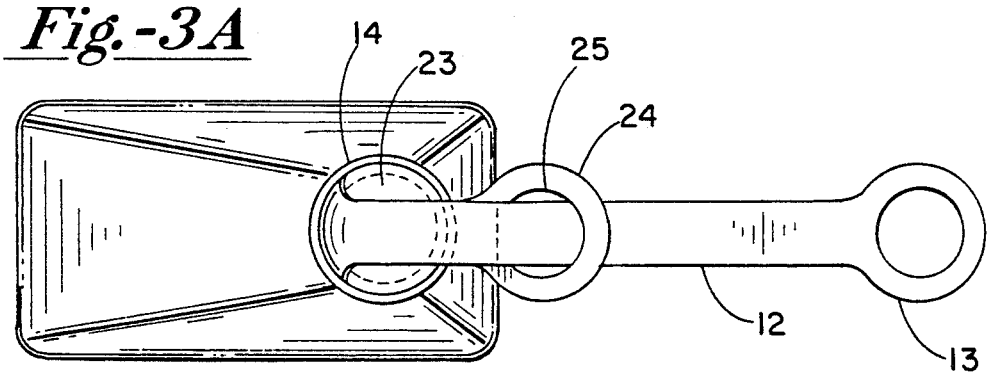
FIG. 3A is a top plan view of the device illustrated in FIG. 3.

Attention now being directed to FIG. 3 of the drawings, where there will be observed that the lanyard 12 is passed through a bail 25 formed by an opening in extension lip 24 of sealing area 14. Extension lip 24 opposing the extension means forming lanyard 12 is much shorter than the extension 12. The bail formed by the hole 25 in lip 24 will locate the lanyard 12 in proper orientation to ensure activation in peel rather than in shear.

DESCRIPTION OF THIRD ALTERNATE PREFERRED EMBODIMENT

Figure 4:
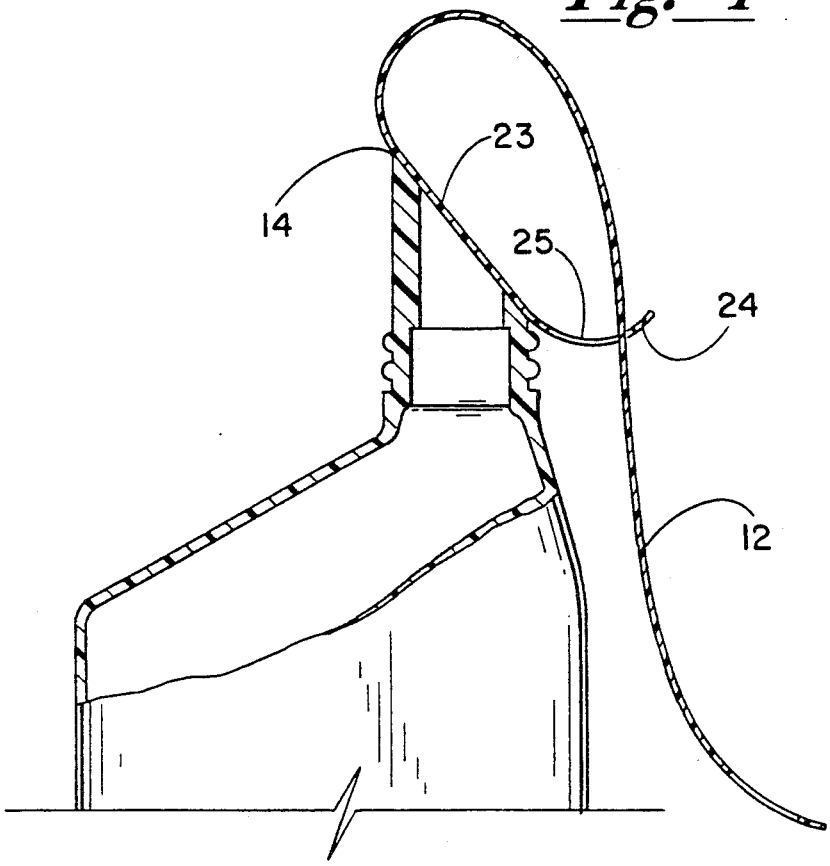
FIG. 4 is similar to FIG. 2, in illustrating the modified spout with the modified seal and lanyard as depicted in FIG. 3.
Figure 4A:
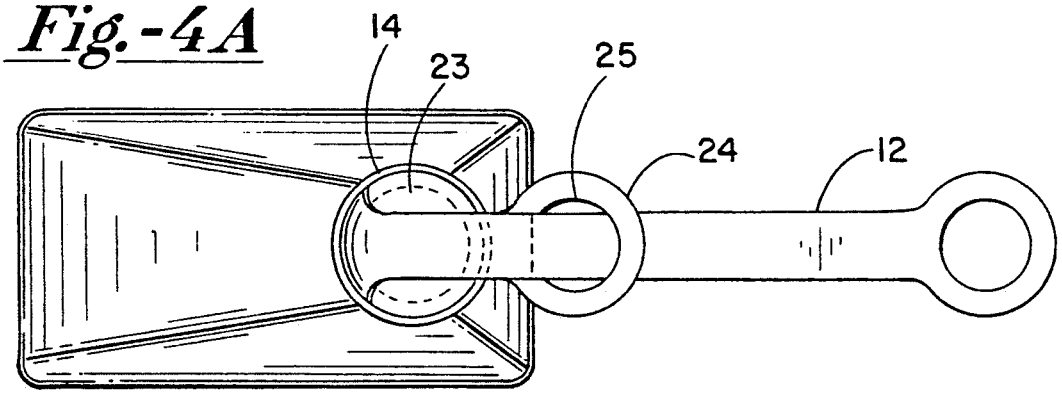
FIG. 4A is a top plan view of the device shown in FIG. 4.

Attention is now directed to FIG. 4 of the drawings where there will be observed a configuration including the teachings of both FIGS. 2 and 3.

DESCRIPTION OF FOURTH ALTERNATE PREFERRED EMBODIMENT

Figure 5:
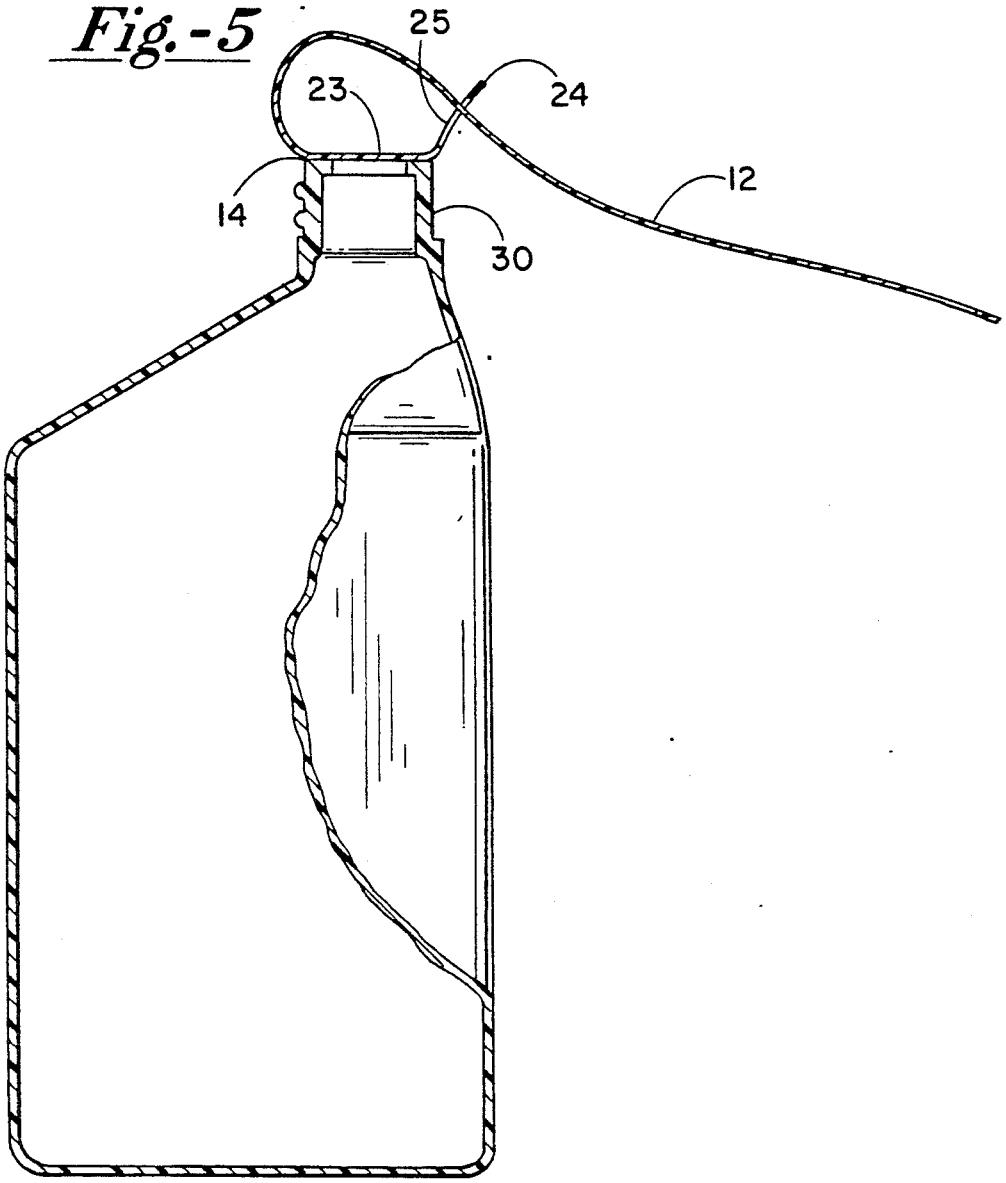
FIG. 5 is a view similar to FIG. 1 and illustrating a container having an indented slot formed in the container spout for accommodation of the pulling extension member.
Figure 5A:
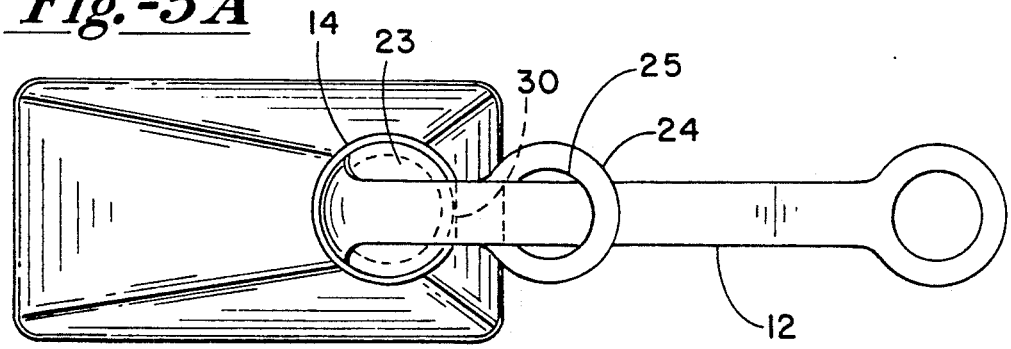
FIG. 5A is a top plan view of the device illustrated in FIG. 5.

Attention is now directed to FIGS. 5 and 5A of the drawings where a configuration is illustrated which includes an indented slot zoned as at 30 formed in the container spout for a combination of the pulling extension member.

DESCRIPTION OF PREFERRED EMBODIMENT WITH CAP ATTACHED

Figure 6:
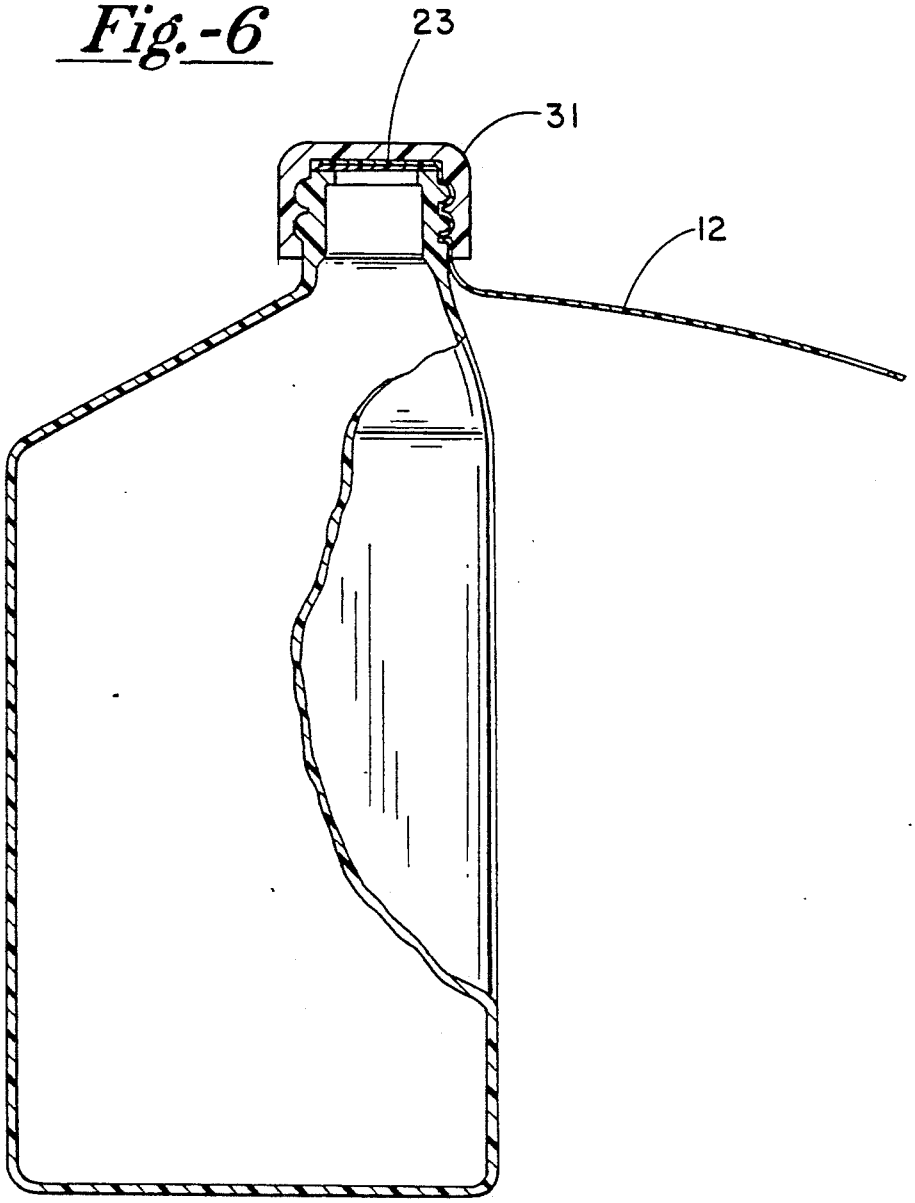
FIG. 6 is a view similar to FIG. 1 and illustrating a container which is fitted with a threadably engaged protective cap.
Figure 6A:
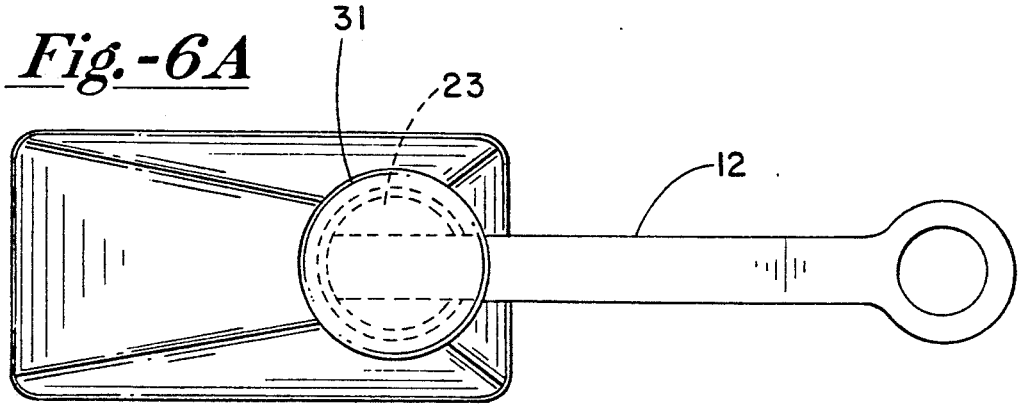
FIG. 6A is a top plan view of the device illustrated in FIG. 6.

Attention is now directed to FIGS. 6 and 6A of the drawings where the container fitted with a threadably engaged protective cap 31.

DESCRIPTION OF FIFTH ALTERNATE PREFERRED EMBODIMENT

Figure 2A:
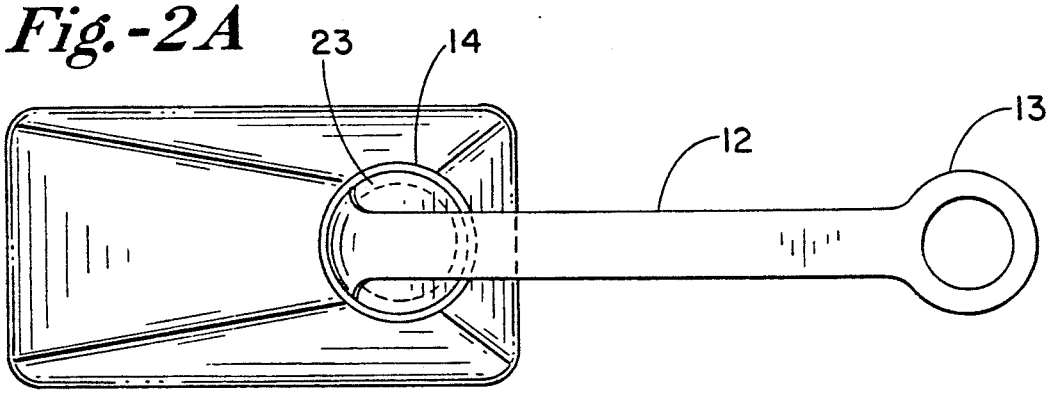
FIG. 2A is a top plan view of the device illustrated in FIG. 2.
Figure 7:
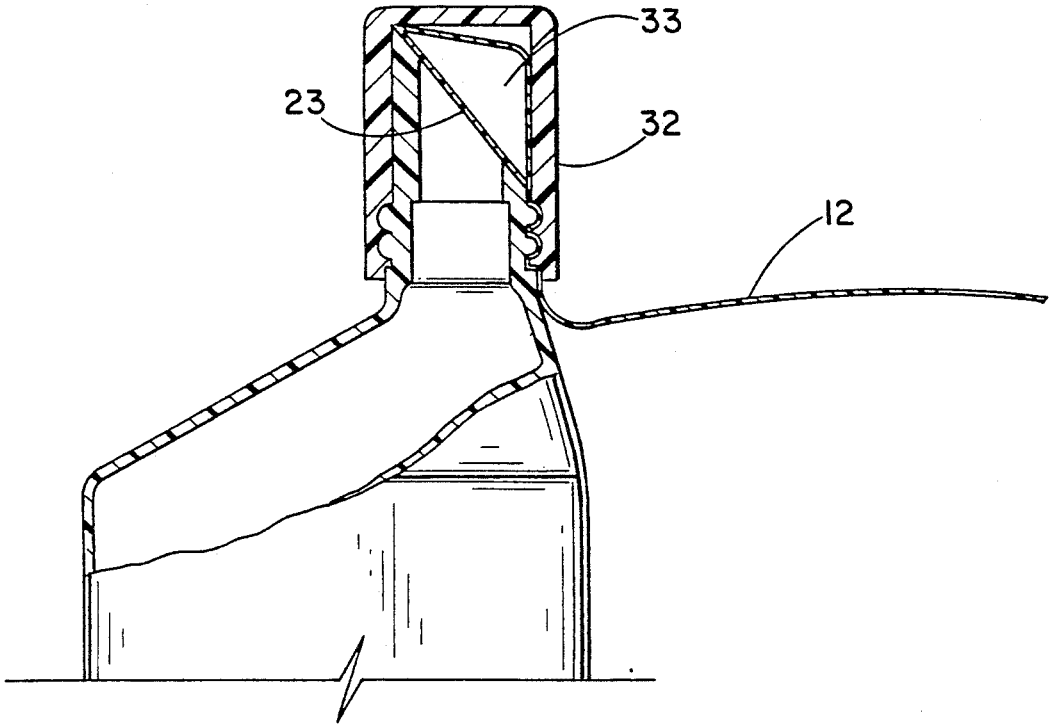
FIG. 7 is a view of the modification illustrated in FIG. 2 and further showing a structure wherein an extension of the pouring spout is arranged distally of a thread means and wherein a cap is threadably secured cap with an extension cavity formed therein.
Figure 7A:
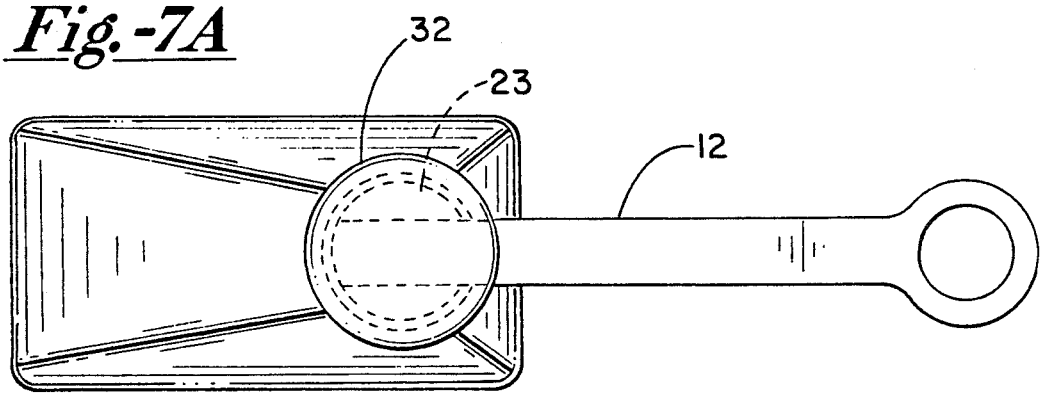
FIG. 7A is a top plan view of the device illustrated in FIG. 7.

Attention is now directed to FIGS. 7 and 7A of the drawings where there is illustrated a configuration including the structural features of the embodiment of FIGS. 2 and 2A, and further illustrating the arrangement wherein a cap means 32 is provided on the spout, and wherein the cap means is a threadably secured cap with an extension cavity as at 33 formed therein.

It will be observed that various modifications may be made of the arrangements disclosed herein without departing form the spirit and scope of the present invention.

What is claimed is:

1. In combination with a container having a spout-like top, a flexible seal with a pulling extension member coupled thereto for applying force from a remote position to removably peel the seal from the container and guide loop means orienting said pulling extension along a desired direction.

2. The combination according to claim 1 with a finger loop formed in the end of the pulling extension.

3. The combination according to claim 1 wherein said container has an indented slot formed in the container spout for accommodation of the pulling extension member.

4. The combination according to claim 1 wherein said container is fitted with a threadably engaged protective cap.

5. The combination according to claim 3, where the indented slot extends through the threaded area of the spout.

6. The combination according to claim 1 wherein the said spout-like top terminates along a planar surface disposed at an acute angle to the axis of the spout and wherein the said flexible seal is mated with said planar surface.

7. The combination according to claim 6 wherein the said flexible seal is disposed on an extension of the pouring spout distally of a thread means and wherein the cap means is a threadably secured cap with an extension cavity therein.

8. The combination according to claim 6 wherein said flexible seal is mated to a planar surface situated at an acute angle to the axis of the spout-like top and wherein the spout-like top is disposed in laterally spaced relationship from the axis of the container and with the pulling extension member extending from said flexible seal along the spout-like top from a point nearest the axis of the container.

* * * * *